United States Patent [19]

Betters

[11] 4,030,166

[45] June 21, 1977

[54] SAFETY PIN

[76] Inventor: Paul D. Betters, 60 Main St., Oakfield, N.Y. 14125

[22] Filed: Dec. 5, 1975

[21] Appl. No.: 638,108

[52] U.S. Cl. ..... 24/156 R; 24/161 R
[51] Int. Cl.[2] ..... A44B 9/14
[58] Field of Search ..... 24/156 R, 161 R, 161 A

[56] References Cited

UNITED STATES PATENTS

| | | | |
|---|---|---|---|
| 773,568 | 11/1904 | Heineman | 24/156 R |
| 1,032,353 | 7/1912 | Machate | 132/48 R |
| 1,135,692 | 4/1915 | Hunsberger | 24/156 R |
| 1,148,292 | 7/1915 | Davey | 24/156 R |
| 2,551,063 | 5/1951 | Sneirson | 24/156 R |
| 3,047,921 | 8/1962 | Lorber | 24/161 R |
| 3,851,359 | 12/1974 | Wilson | 24/150 SP |

FOREIGN PATENTS OR APPLICATIONS

| | | | |
|---|---|---|---|
| 140,077 | 4/1902 | Germany | 24/156 R |
| 403,567 | 10/1924 | Germany | 24/156 R |
| 91,015 | 10/1921 | Switzerland | 24/156 R |

*Primary Examiner*—Bernard A. Gelak
*Attorney, Agent, or Firm*—Mason, Fenwick & Lawrence

[57] ABSTRACT

An injection molded safety pin particularly for use as a laundry net pin or for attachment of hunting tag holders to jackets and the like, said pin including a free shaft having a pointed first end with a groove which is transverse the shaft and adjacent the pointed end, a fixed shaft integrally connected at one end by a U-shaped portion to the second end of the free shaft, a head assembly integral with the second end of the fixed shaft and having a slot which is narrower than the free shaft to receive said first free end of the free shaft with a protrusion extending into the slot to engage the transverse groove on the shaft, said head assembly may include a spring biased clip or a wall which prevents the free shaft from deflecting out of the slot.

3 Claims, 18 Drawing Figures

SAFETY PIN

This invention relates generally to fastening devices and more specifically to a single piece, injected molded, heavy duty safety or laundry net pin with a clip lock feature.

Previously known heavy duty safety pins have been made of heavy gauge steel or brass wire. In commercial laundries, brass pins have been used because of their resistance to the chemicals used in the laundering processes; however, they have had significant drawbacks because they are heavy, retain heat for long periods of time, have excessive spring tension, and are expensive to manufacture. Steel pins have occasionally been used in heavy duty applications; however, they are also heavier, corrode faster, have excessive spring tension, and are also expensive. Previously known plastic pins have not been adapted to heavy duty use in laundries or as a heavy duty safety pin.

There are plastic materials such as Delrin with sufficient strength to form safety pins. When these materials are molded in a long rod such as the free shaft of a safety pin, the free shaft is too flexible because it deflects easily under small loads. The shaft and its free end easily pull or bend out of any conventional safety pin head. If the pins are formed from a very rigid plastic, the shafts will easly break when the shafts are of small diameter. When the pins are molded with a large diameter to prevent the deflection, the free shaft would not penetrate many clothing materials or damage the appearance and strength of the fabrics thereby making these pins undesirable and difficult to manipulate.

It is a primary object of the present invention to provide a new and improved heavy duty plastic safety pin.

A further object of the present invention is to provide a more efficient commercial safety pin with an integral locking and holding device which enables a reduction in the diameter of the pin shafts while retaining sufficient strength and preventing the pin from opening until forced open by the user.

An additional object of the present invention is to provide a less hazardous safety pin for human users by significantly reducing the spring loaded tension of heavy duty pins and molding the pin with flexible shafts of sufficient strength.

Another object of the present invention is to reduce the diameter of the legs of a plastic heavy duty safety pin and the spring tension of the legs.

A further object of the present invention is to provide an integral positive holding device for the free shaft of a heavy duty safety pin which enables manufacture from very economical plastic material.

An additional object of the present invention is to form a safety pin of a strong flexible plastic material to produce a pointed free shaft which is much less hazardous.

A further object of the present invention is to provide a safety pin which is more comfortable and less hazardous when attached to clothing.

A better understanding of the manner in which the preferred embodiment of the subject invention achieves the objects of the invention will be enabled when the following written description is read in conjunction with the appended drawings.

Figure 1:
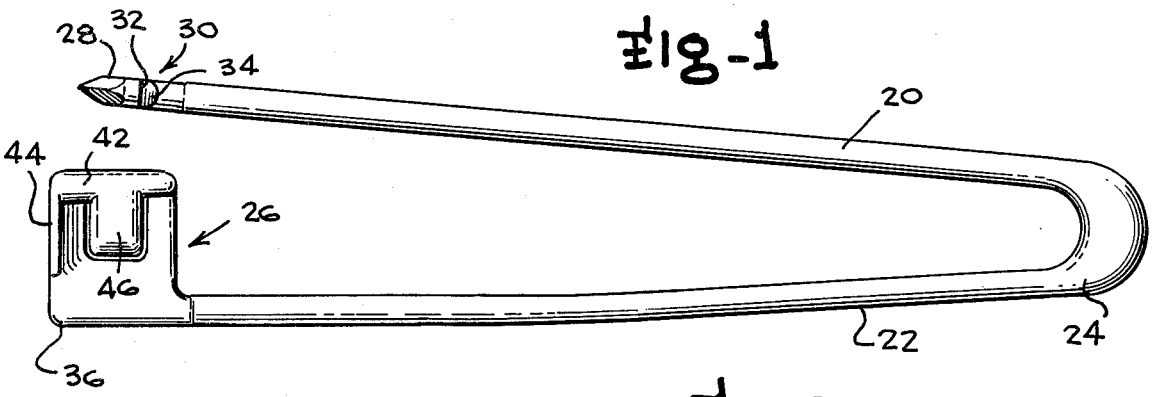
FIG. 1 is a top elevational view of a safety pin in the open position embodying the invention.

Referring to the drawings, there is illustrated a safety pin embodying the invention which includes a free shaft 20, a fixed shaft 22 connected to the free shaft by a U-shaped portion 24, and a head assembly 26.

The safety pin according to the present invention functions in a manner similar to conventional safety pins; however, the unique features of the head assembly and free shaft permit the fabrication of the safety pin from plastic material which may be quite flexible.

Figure 2:
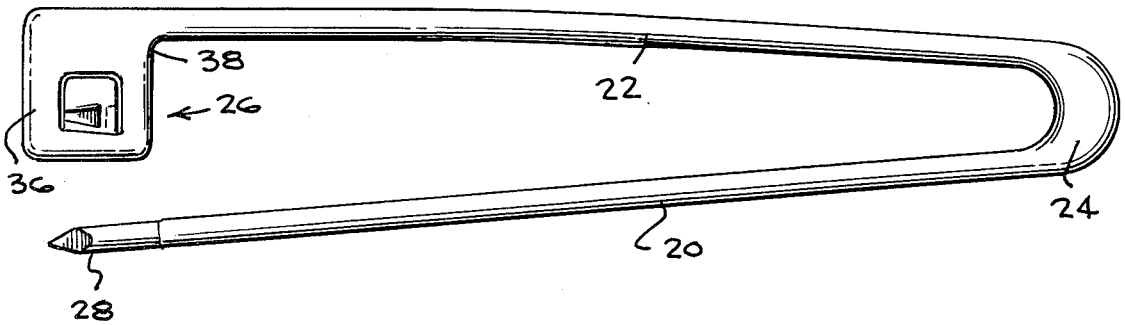
FIG. 2 is a bottom elevational view of the embodiment illustrated in FIG. 1.
Figure 3:
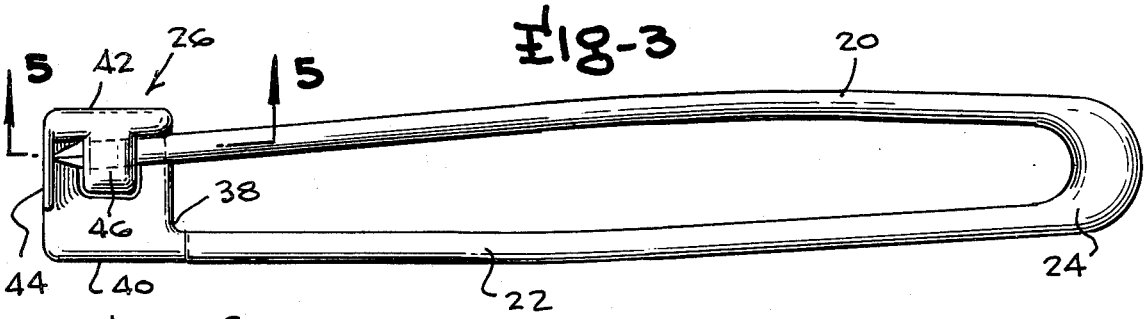
FIG. 3 is a top elevational view of the embodiment illustrated in FIG. 1 with the safety pin in the closed position.
Figure 4:
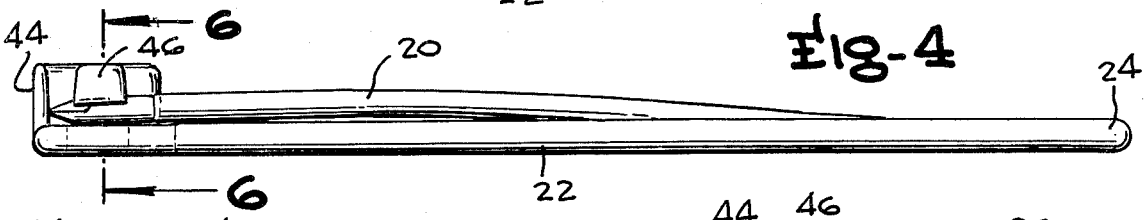
FIG. 4 is a side elevational view of the embodiment as illustrated in FIG. 3.
Figure 5:
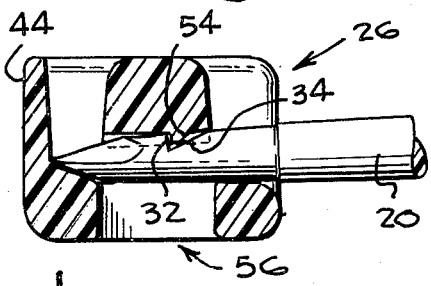
FIG. 5 is an enlarged cross-sectional view taken along lines 5—5 of FIG. 3.
Figure 6:
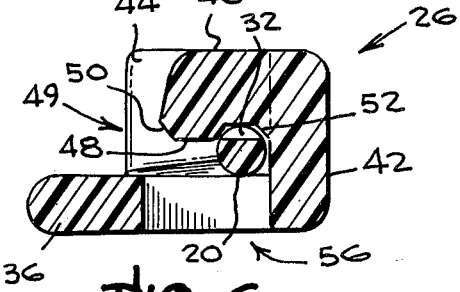
FIG. 6 is an enlarged cross-sectional view taken along lines 6—6 in FIG. 4.

The free shaft 20 is a small diameter rod with the shaft naturally biased away from the head assembly 26 when the safety pin is open as shown in FIGS. 1 and 2. The free end 28 of the free shaft is pointed to permit penetration through fabric and the like when the pin is used for its intended purpose. Adjacent the pointed end is a groove 30 formed by a forward surface 32 which is perpendicular to the axis of the free shaft 20 and a rear surface 34 which is inclined to the forward wall and the axis of the free shaft. The U-shaped portion 24 is of larger cross-section than the free shaft 20 in order to withstand the high bending stresses applied by the free shaft 20.

The fixed shaft 22 is a rod of the same diameter as the free shaft and is formed integrally with the U-shaped portion 24 at one end and the head assembly 26 at the other end.

The head assembly 26 includes a back wall 36 which is generally rectangular with the fixed shaft 22 extending from a forward corner 38 of the back wall and extending parallel to the front edge 40 of the back wall. A rear wall 42 extends upwardly from the rear edge of the back wall and a retaining wall 44 extends upwardly from the adjacent side edge 46 of the back wall opposite the fixed shaft. The rear wall 42 and the retaining wall 44 join at the corner of the back wall thereby forming a strong structure.

Extending from the upper free edge of the back wall 42 and parallel to the back wall is a tab 46 which creates a slot 49 between the tab 46 and the back wall 36 to receive the pointed end 28 of the free shaft 20. The lower face 48 of the tab 46 is spaced apart from the back wall 36 a distance slightly less than the diameter of the free shaft to form the slot 49 thereby requiring a force to insert the free shaft into the slot. A ramp portion 50 at the front edge of the lower face 48 permits the shaft to be easily inserted into the slot while a depression 52 in the lower face 48 at the bottom of the slot permits the tab to spring back to its original position after the free shaft has been inserted into the slot. This action retains the free shaft in the closed position shown in FIGS. 3 through 6.

A wedge protrusion 54 extends into the slot from the lower face 48 at position to engage the groove 30 in the free shaft after the free shaft 20 is inserted into the slot 49. The engagement of the wedge protrusion 54 with the groove 30 prevents the free shaft 20 from being withdrawn axially from the slot. This locking action permits fabrication of the safety pin from a flexible plastic material since the free shaft will not become disengaged from the head assembly unless desired.

A mold opening 56 which is positioned in the back wall 36 opposite the tab 46 and is at least equal to the size of the tab permits the safety pin to be formed in an upper and lower die without requiring any movable cores. The lower die forms the bottom half of the safety pin and the lower surface 48.

To realize maximum strength, the pin is formed by injecting hot plastic into the head assembly central of the front edge 40 of the back wall 46. This will force the plastic molecules directly out the fixed shaft 22 and through free shaft 28 to the point 28. Molding by this method will eliminate possible weak locations and will provide maximum strength for the fixed shaft and the free shaft by aligning the molecules. The fill of plastic in the head piece will be random which makes the head less flexible and permits minimum wall thickness.

By minimizing the spring tension and maintaining flexibility in the free and fixed shafts, the safety pin will not only be easier to use, but also much safer. The flexibility of the free shaft will reduce the knife or stabbing effect and the low spring tension in the free shaft will prevent the strong springback of the free shaft when released from the head piece as occurs in conventional pins.

Figure 7:
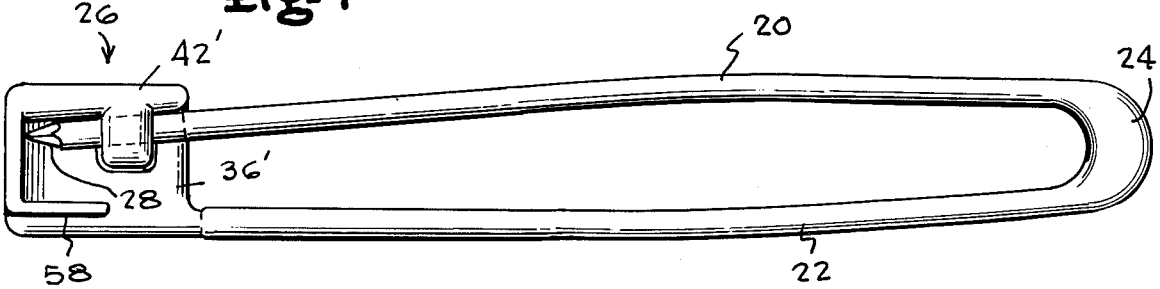
FIG. 7 is a top elevational view of an alternative embodiment of the present invention with the safety pin in the closed condition.
Figure 8:
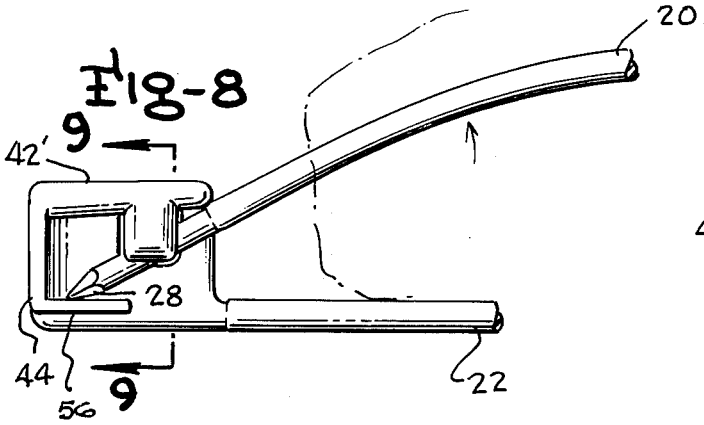
FIG. 8 is a fragmentary view of the embodiment illustrated in FIG. 7 with the free leg being biased outwardly.
Figure 9:
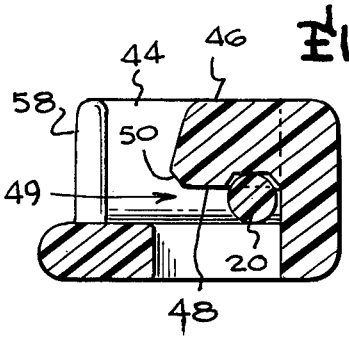
FIG. 9 is an enlarged cross-sectional view taken along lines 9—9 in FIG. 8.

In the alternate embodiment shown in FIGS. 7, 8 and 9, a second retaining wall 58 extends upwardly from a back wall 36' parallel to the rear wall 42' and spaced apart from the tab 46. The free shaft 20 may be inserted between the second retaining wall 56 and the tab 46 and into the slot 49. The second retaining wall prevents the free shaft 20 from being pulled out of the slot when the free shaft is forced outwardly as shown in FIG. 8.

Figure 10:
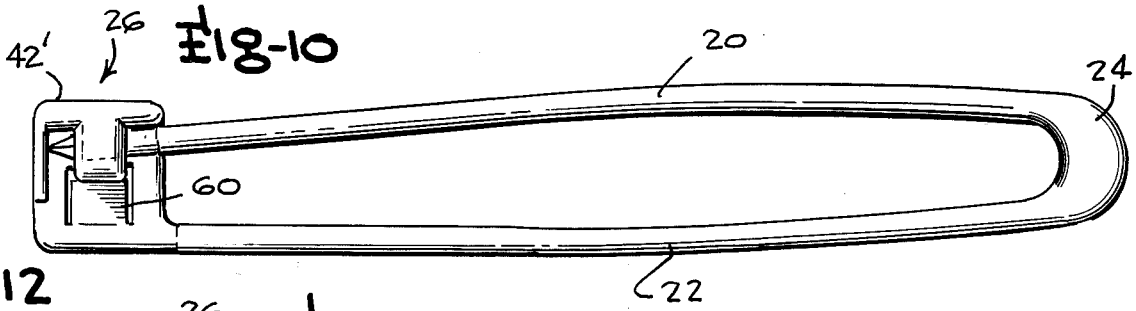
FIG. 10 is a top elevational view of a second alternative embodiment of the present invention with the safety pin in the closed condition.
Figure 11:
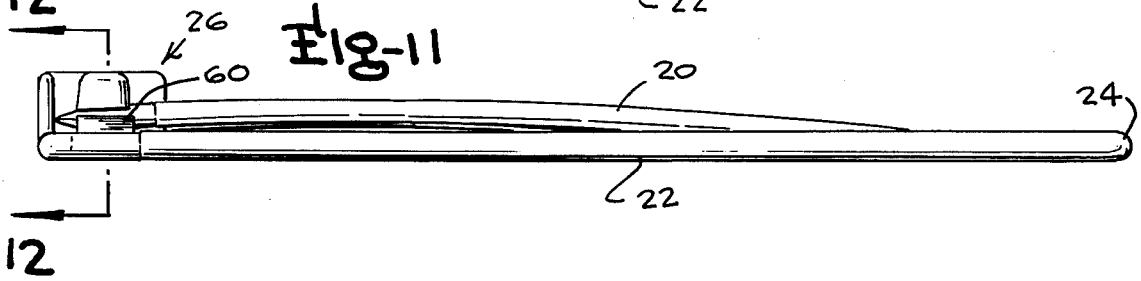
FIG. 11 is a side elevational view of the embodiment shown in FIG. 10.
Figure 12:
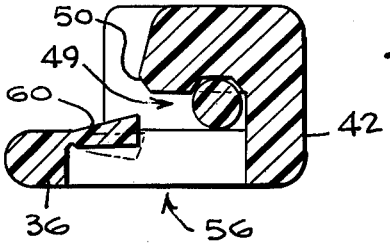
FIG. 12 is an enlarged cross-sectional view taken along lines 12—12 in FIG. 11.

In the second alternate embodiment shown in FIGS. 10, 11 and 12, a spring biased clip 60, which is integral with the back wall 36, projects into the mold opening 56, toward the rear wall 42 and above the upper surface of the bottom wall 36 to provide a means for preventing removal of the free shaft from the slot until the clip 60 is manually biased into the mold opening 56 by the user.

Figure 15:
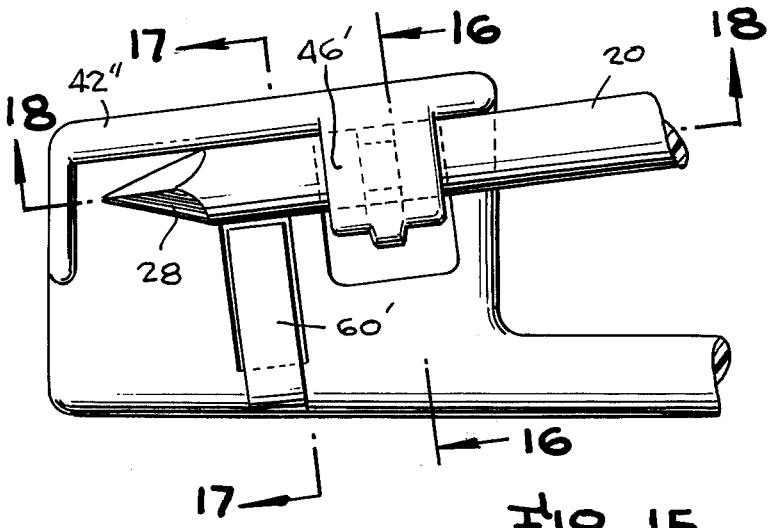
FIG. 15 is a fragmentary enlarged view of the embodiment shown in FIG. 13.
Figure 18:
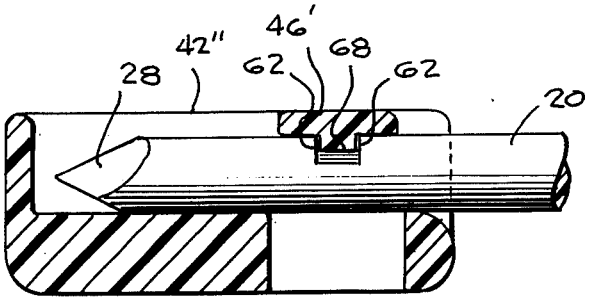
FIG. 18 is a cross-sectional view taken along lines 18—18 in FIG. 15.

The alternate embodiment of FIGS. 13 through 18 shows a groove 30' on the free shaft 20 with parallel end surfaces 62 which are perpendicular to the outer surface of the free shaft and with a space 64 therebetween which is semi-cylindrical. A semi-cylindrical protrusion 68 on the lower surface 48' of the tab 46' is complementary in shape to the space 64 and locks the free shaft 20 in position in the closed position as shown in FIGS. 15 and 18.

Figure 13:
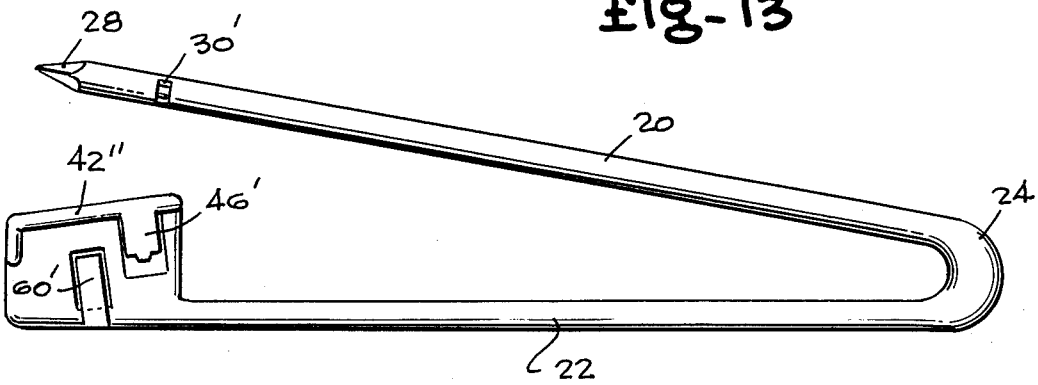
FIG. 13 is a top elevational view of a third embodiment of the present invention with the safety pin in an open condition.
Figure 14:
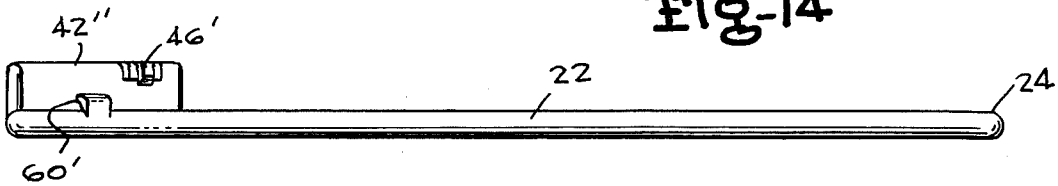
FIG. 14 is a side elevational view of the embodiment shown in FIG. 13.
Figure 16:
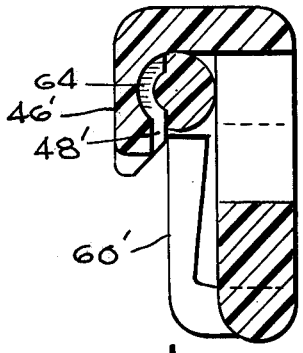
FIG. 16 is a cross-sectional view taken along lines 16—16 in FIG. 15.
Figure 17:
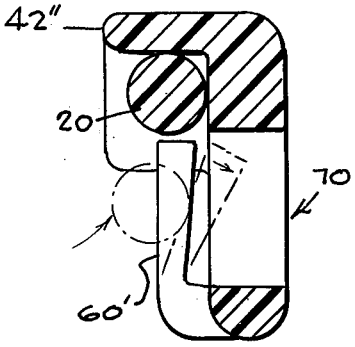
FIG. 17 is a cross-sectional view taken along lines 17—17 in FIG. 15.

A spring biased clip 60', similar to clip 60 in FIGS. 10, 11 and 12, extends into a clip opening 70 in the back wall 36' adjacent the free shaft 20 when it is in the closed position as shown in FIGS. 15, 16 and 17 to prevent removal of the free shaft from the slot unless manually depressed by the user. The rear wall 42'' may be inclined slightly as shown in FIGS. 13 and 15 to receive the free shaft at the angle it assumes when deflected into the slot.

From the foregoing detailed description, it will be evident that there are a number of changes, adaptations and modifications of the present invention which come within the province of those skilled in the art. However, it is intended that all such variations not departing from the spirit of the invention be considered as within the scope thereof and as limited solely by the appended claims.

I claim:

1. A reusable safety pin formable in a single plastic injection molding, said safety pin comprising a free shaft having a first end with an indentation on one side only of said shaft adjacent said first end, a fixed shaft connected at one end by a resiliently flexible portion to the second end of the free shaft, and a head assembly connected to the second end of the fixed shaft, said head assembly including a back wall with a mold opening therethrough and with a resilient projection integrally formed with the back wall and extending above the back wall, a rear wall integral along one edge with said back wall and extending upwardly from said back wall, a tab extending inwardly from said rear wall and over said mold opening in said back wall, said tab positioned above said back wall at a height approximately equal to the thickness of said first end of said free shaft to provide a receiving slot for said free shaft, said tab including a downwardly projecting protrusion positioned over said mold opening and engageable with said indentation on said free shaft when said free shaft is inserted under said tab, said protrusion preventing axial movement of said free shaft, said resilient projection on said back wall positioned adjacent the free shaft when the free shaft is positioned in said receiving slot to increase the force required to remove the free shaft from the receiving slot thereby providing a reusable safety pin formable in a single injection molding without requiring the use of movable cores during the injection molding process.

2. The reusable safety pin of claim 1 wherein said resilient projection includes a clip opening in the back wall and a clip integrally formed with the back wall and extending above said clip opening.

3. A reusable safety pin formable in a single plastic injection molding without the use of movable cores, said safety pin comprising a free shaft having a groove in said shaft adjacent a first end of said free shaft, a fixed shaft connected to one end by a resilient U-shaped portion to the second end of the free shaft, and a head assembly connected to the second end of the fixed shaft, said head assembly including a back wall with a mold opening therethrough and with a clip means formed in said back wall, a rear wall integral with said rear wall and extending upwardly from said back wall, a tab extending inwardly from said back wall and over said mold opening in said back wall, said tab positioned above said back wall at a height approximately equal to the thickness of said first end of said free shaft to provide a receiving slot for said free shaft, said tab including a downwardly projecting protrusion engageable with said groove on said free shaft when said free shaft is inserted under said tab to prevent axial movement of said free shaft, said clip on said back wall positioned adjacent the free shaft to resist removal of the free shaft from said receiving slot, said groove having generally parallel side walls perpendicular to the axis of said first end of said shaft and a raised portion at the bottom of said groove and said protrusion on said tab having a shape complementary to said groove on said free shaft thereby providing a reusable safety pin formable in a single injection molding without requiring the use of movable cores during the injection molding process.

* * * * *